US011517132B2

(12) United States Patent
Raykhman

(10) Patent No.: US 11,517,132 B2
(45) Date of Patent: Dec. 6, 2022

(54) TWO-HANDED CLIP-ON CUP HOLDER

(71) Applicant: Svetlana Raykhman, Manalapan, NJ (US)

(72) Inventor: Svetlana Raykhman, Manalapan, NJ (US)

(73) Assignee: SR THERACARE PROFESSIONAL CORPORATION, Manalapan, NJ (US)

( * ) Notice: Subject to any disclaimer, the term of this patent is extended or adjusted under 35 U.S.C. 154(b) by 0 days.

(21) Appl. No.: 17/346,603

(22) Filed: Jun. 14, 2021

(65) Prior Publication Data

US 2021/0393060 A1 Dec. 23, 2021

Related U.S. Application Data

(60) Provisional application No. 63/042,120, filed on Jun. 22, 2020.

(51) Int. Cl.
*A47G 23/02* (2006.01)

(52) U.S. Cl.
CPC ..... *A47G 23/0216* (2013.01)

(58) Field of Classification Search
CPC .. A61J 9/06; A61J 9/063; A61J 9/0646; A61J 9/0623; A47G 23/0216; A47G 23/02; A47G 23/0208; A47G 23/0225
See application file for complete search history.

(56) References Cited

U.S. PATENT DOCUMENTS

| | | | | |
|---|---|---|---|---|
| 1,016,323 | A * | 2/1912 | Dixon | A61J 9/06 248/106 |
| 6,557,297 | B2 * | 5/2003 | Receveur | A47G 7/041 47/65.5 |
| 8,231,094 | B1 | 7/2012 | Barnes | |
| 9,089,234 | B2 * | 7/2015 | Webb | A47G 23/02 |
| 10,099,594 | B2 | 10/2018 | Salinas | |
| 10,343,576 | B1 | 7/2019 | Rojo et al. | |
| 2010/0288801 | A1 * | 11/2010 | Messner | A45F 5/02 224/101 |
| 2014/0138396 | A1 * | 5/2014 | Altermatt | A61J 9/0638 220/737 |
| 2014/0197125 | A1 * | 7/2014 | Makrinos | A61J 9/0623 215/11.1 |
| 2014/0239134 | A1 * | 8/2014 | Webb | A47G 23/0225 248/125.3 |
| 2016/0038375 | A1 * | 2/2016 | Hesketh | A61G 7/0503 220/737 |
| 2018/0207353 | A1 * | 7/2018 | Hesketh | A61M 5/1415 |

* cited by examiner

*Primary Examiner* — Don M Anderson
(74) *Attorney, Agent, or Firm* — Moser Taboada

(57) ABSTRACT

A two-handed clip-on cup holder is an adaptive drinking device to allow users with limited hand grip strength to be able to drink independently from assistance of caregivers. The device features a claw-like clip and flexible two cup handles attached to a central rod. At the bottom of the rod, there is a secure base attached where the cup is sitting. The rod has adjustable hook at its top that further secures attachment of the device to the cup. Rod has an extension to adjust for different height cups.

3 Claims, 4 Drawing Sheets

TWO-HANDED CLIP-ON CUP HOLDER

FIELD OF INVENTION

The present invention relates in general to a field of adaptive technology for people with limited hand grip functionality. It allows them to use the same device in conjunction with cups of different sizes and material including but not limited to paper and plastic.

BACKGROUND OF THE INVENTION

Adaptive drinking devices help users maintain their ability to drink independently. Drinking aids are designed to allow users who have difficulty holding standard cups and glasses to be able to drink with little or no assistance from their caregivers. Caregivers will find these adaptive drinking devices help their loved ones hold cups, drink beverages, or help provide liquids to an individual who cannot drink on their own.

SUMMARY OF THE INVENTION

The present invention pertains to an adaptive drinking technology device that provides simple, convenient, and economical way for users with limited hand grip to be able to drink liquids from cups or glasses of different sizes and materials.

The first aspect of an embodiment of the invention demonstrates the adoptive drinking device and a clip-on system designed to hold the drinking cups.

A further aspect of an embodiment of the invention demonstrates the adoptive drinking devices with adjustable height to fit the height of the cup.

A further aspect of an embodiment of the invention demonstrates the device dual handlers that could be adjusted from the drinking point to the preference of the user.

A further aspect of an embodiment of the invention demonstrates the security and stability of the of the device by having bottom base serving as a surface of the cup to prevent spillages or turnovers.

BRIEF SUMMARY OF DRAWINGS

Various embodiments of the present disclosure are described. The components of the drawings are not necessarily to scale as emphasis is placed upon illustrating the principals of corresponding disclosure.

DETAILED DESCRIPTION OF THE INVENTION

The following description is merely exemplary in nature and is not intended to limit present disclosure, application, or users.

Figure 1:
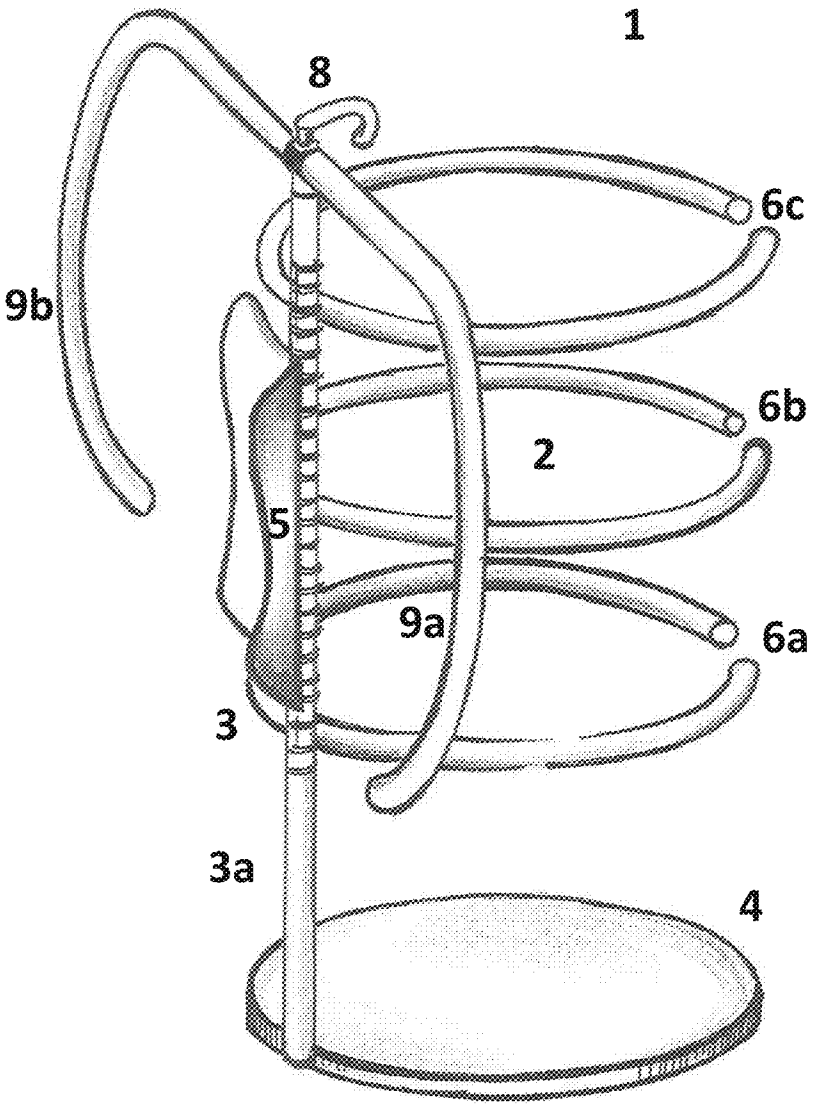
FIG. 1 illustrates a perspective view of an embodiment of two-handed clip-on cup holder with cup being inserted into it

Referring to FIG. 1, and integration of two-handed cup holder 1 with clip-on and the cup container 2 is provided. As shown, the embodiment includes rod 3 with extension 3*a* attached to the base 4 that can be adjusted to the height of the cup. Moreover, clip handles 5 can be pushed inside to spread the three claws 6*a*, 6*b*, 6*c* and released outside for best container fitting. Spring 7 inside the handles holds them fitted to the container during extension and allows container to be released during flexion. FIG. 1 hook 8 on top of the rod 3 is employed to further secure an open container to the embodiment. If the container includes the cover, the hook can be turned to the outside of the container. The semi-circle shaped user handles 9*a* and 9*b* attached to the top of the rod 3 can be adjusted outwards to the preference of the applicant.

Figure 2:
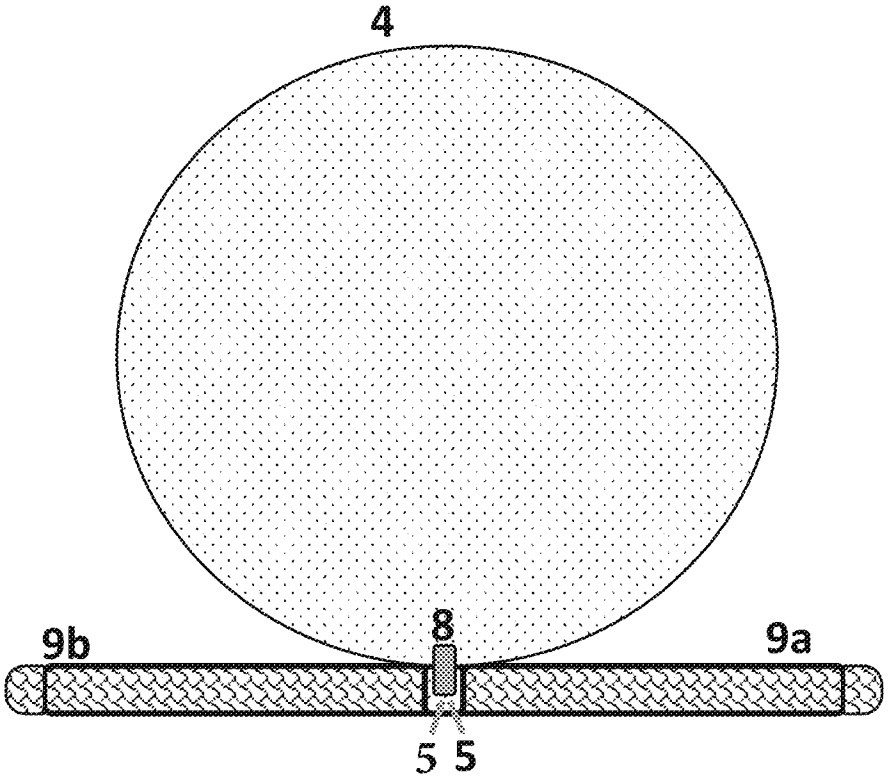
FIG. 2 illustrates a top perspective view of an example of two-handed clip-on cup holder in accordance with certain aspects of the present disclosure
Figure 3:
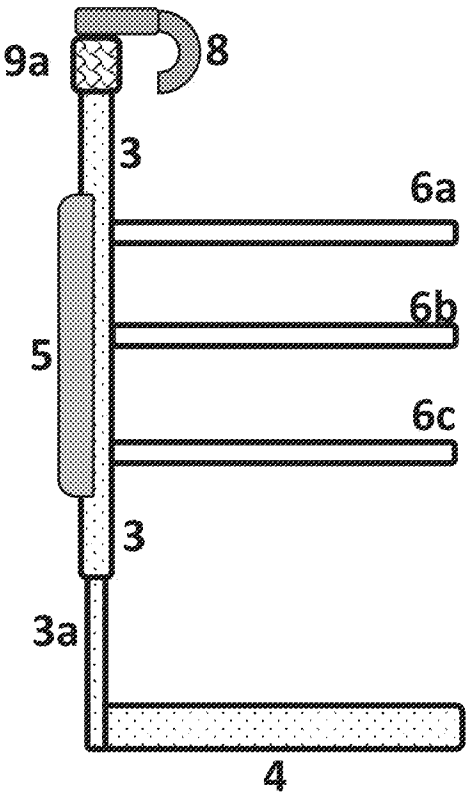
FIG. 3 illustrates a right and left perspective view of an example of two-handed clip-on cup holder in accordance with certain aspects of the present disclosure
Figure 4:
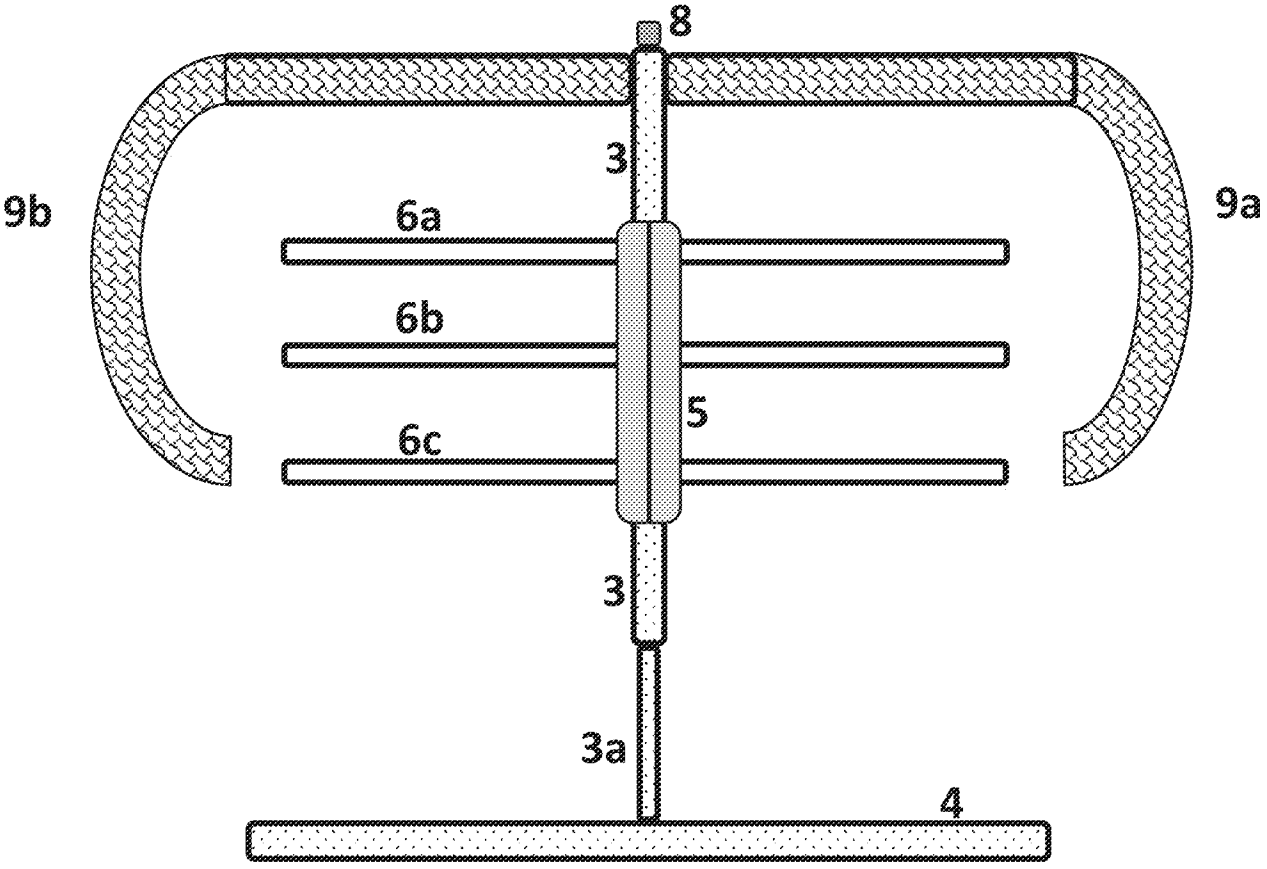
FIG. 4 illustrates a back perspective view of an example of two-handed clip-on cup holder in accordance with certain aspects of the present disclosure

FIG. 2, FIG. 3, and FIG. 4 have corresponding top, back, and side views of the embodiment with corresponding projections of numbered above elements.

What is claimed is:

1. An adjustable cup holder device for adaptive drinking, comprising of:

a drinking container holder base;

a rod with an extension for container height adjustment, attached to the drinking container holder base;

three round shape holders attached to the rod and connected to clip handles;

a spring inside the clip handles, allowing the holders to extend and contract; and a rotatable hook attached to a top end of the rod that is configured to secure a container with no lids and top covers.

2. An adjustable cup holder device for adaptive drinking according to claim 1, further comprising semi-circle shaped user handles attached to the top of the rod, wherein the user handles can be adjusted outwards to the preference of a user.

3. An adjustable cup holder device for adaptive drinking according to claim 2, wherein the rod is extended to adjust for the height of the container.

* * * * *